US006509878B1

(12) United States Patent
Tornatta, Jr. et al.

(10) Patent No.: US 6,509,878 B1
(45) Date of Patent: Jan. 21, 2003

(54) ANTENNA MOUNTING SYSTEM

(75) Inventors: Paul Anthony Tornatta, Jr., Vancouver, WA (US); Douglas W. Sherman, Battleground, WA (US); Kee Kean Hoo, Vancouver, WA (US)

(73) Assignee: Radiall/Larsen Antenna Technologies, Inc., Vancouver, WA (US)

( * ) Notice: Subject to any disclaimer, the term of this patent is extended or adjusted under 35 U.S.C. 154(b) by 0 days.

(21) Appl. No.: 09/825,089

(22) Filed: Apr. 2, 2001

(51) Int. Cl.[7] ..... H01Q 1/32
(52) U.S. Cl. ..... 343/715; 343/906
(58) Field of Search ..... 343/715, 711, 343/712, 713, 906, 878, 882; 248/514, 539

(56) References Cited

U.S. PATENT DOCUMENTS 3,944,722 A * 3/1976 Larsen ..... 343/715
4,482,122 A * 11/1984 Grashow ..... 248/514
6,157,345 A * 12/2000 Hockett et al. ..... 343/715

* cited by examiner

*Primary Examiner*—Tan Ho
(74) *Attorney, Agent, or Firm*—Klarquist Sparkman, LLP

(57) ABSTRACT

An antenna mounting system includes a first mount having a positioning portion adapted to extend through an opening in a vehicle panel to position and hold the first mount relative to the vehicle panel, a second mount adapted to be disposed adjacent the opposite surface of the vehicle panel, and a connector adapted to couple the first and second mounts to each other. A conductive plate associated with one of the mounts forms a capacitive coupling with the vehicle panel and in conjunction with an inductor or resistor provides a selected resistance to ground. A connector screw in the system has a weakened section which during installation will break should excessive forces be applied thereto, thus to protect other components in the system.

62 Claims, 4 Drawing Sheets

140
72
52
62
98
36
66
74
54
A 152
140b
155
140c
18
114
112
114a
112a
130
108
154
140e
116
118
58
20
10
112a
134
84A
132
84B
22
118a
38
62
36
94
80
92
90
104
96
102
98
100
52
5
54
60
50
66
88
140a
140
28
B

ANTENNA MOUNTING SYSTEM

TECHNICAL FIELD

The present disclosure relates to an antenna mounting system and method, and more particularly, to such a system and method for mounting an antenna on a vehicle.

BACKGROUND

Prior antenna mounting systems and methods have not always provided for the convenient and secure mounting of antennas on vehicles. Prior systems often have been such as to require multiple parties to hold parts of the antenna system inside and outside the vehicle, align the parts properly interiorly and exteriorly, and then fasten the two together. Further, with the advent of telematic systems, such as the OnStar communications network, specific requirements relating to mounting, grounding and other features are required. For example, if an antenna acts like an open circuit, some telematic systems will not recognize the antenna. In order to recognize the antenna, a certain resistance to ground is required. In some instances, this must be less than10 KOHMS.

One problem with prior antenna mounts is that to obtain an appropriate connection to ground, paint on the vehicle panels has been scored, or marred in other ways, when installation occurs to provide contact with the vehicle panel to complete a circuit.

SUMMARY OF THE DISCLOSURE

One aspect of the present disclosure is the provision of an antenna mounting system which includes a first mount adapted to be disposed adjacent one surface of the vehicle panel and having a positioning portion adapted to extend through an opening in the vehicle panel, a second mount adapted to be disposed adjacent a surface of the vehicle panel opposite the first-mentioned surface, a connector adapted to couple the first and second mounts to each other, and a conductive plate associated with one of the mounts adapted to form a capacitive coupling with the vehicle panel without requiring scoring, scratching or otherwise marring the paint on the vehicle panel.

More specifically, as aspect of the disclosure is to provide one of such mounts with both a positioning connection portion and a snap-fit connection portion, such that one person may install the first mount on the vehicle panel and then connect the second mount thereto.

Another aspect of the disclosure is the provision of a method for attaching an antenna mount system to a vehicle including the steps of placing a first mount adjacent one surface of a vehicle panel, inserting a positioning portion through an opening formed in the panel, retaining the first mount in a predetermined position relative to the panel, and placing a second mount adjacent a surface of the panel opposite the one surface and coupling the second mount to the first mount.

A further aspect of the disclosure is to provide a method of attaching an antenna to a vehicle in which a capacitive coupling is provided to electrically couple an antenna to the vehicle while maintaining a selected range of resistance to ground.

These and other aspects of the disclosure will become more fully apparent as the following description is read in conjunction with the following drawings.

DETAILED DESCRIPTION OF PREFERRED EMBODIMENT

Figure 1:
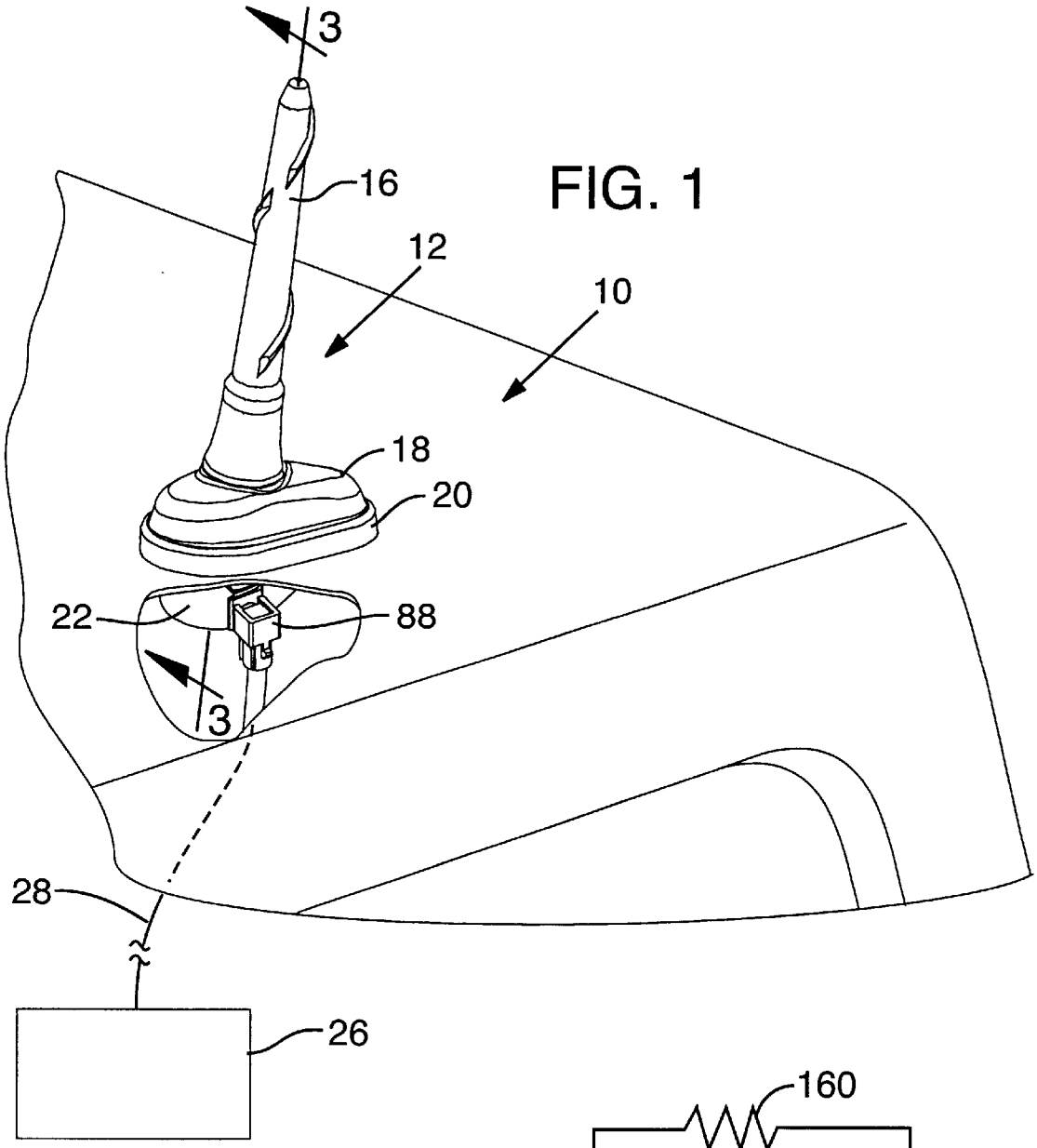
FIG. 1 is a perspective view of a portion of the roof of a vehicle illustrating an antenna mount system, or assembly, according to an embodiment of the invention.

Referring to the drawing, and first more specifically to FIG. 1, at 10 is indicated generally a roof panel of a vehicle on which an antenna mount assembly, or system,12 according to an embodiment of the invention is mounted. A portion of roof panel 10 of the vehicle is broken away to show components of assembly 12 which are mounted on the interior surface of panel 10.

The assembly 12 includes a housing 16 for an antenna radiator, an external mount 18, an elastomeric seal, or boot, 20, and an internal mount 22. Indicated generally at 26 is an electronic telematic system operatively connected through a coaxial cable 28 to antenna system 12, such that signals may be received or radiated by antenna system 12 for the telematic system, 26.

Figure 2:
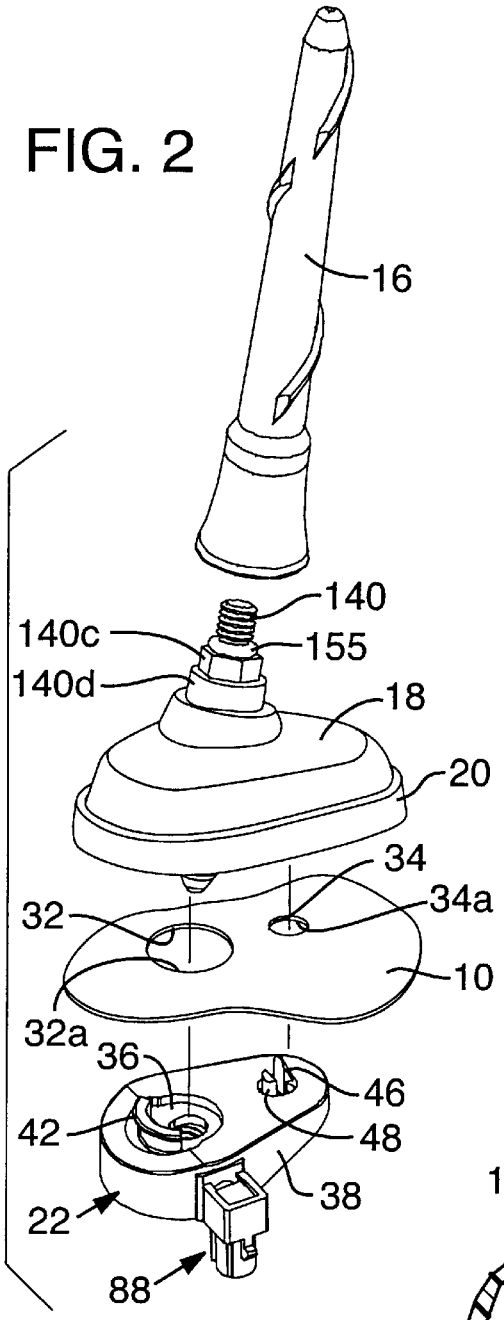
FIG. 2 is an exploded perspective view of portions of the system of FIG. 1 prior to installation.

Referring to FIG. 2, roof panel 10 is illustrated as having two circular openings 32, 34 formed therein. Opening 32 is illustrated as having a greater diameter than opening 34. A first edge margin 32*a* for opening 32 is shown spaced from a second edge margin 34*a* for opening 34. Although two openings are shown herein, is should be recognized that only one opening might be provided with a somewhat oval configuration, but still having the spacing of the most remote marginal edges 32*a*, 34*a* of openings 32, 34.

Describing internal mount 22, this includes a main body 36 and a cover 38. Body 36 may be composed of an electrically non-conductive material, such as plastic, while cover 38 is composed of an electrically-conductive material to provide a conductive plate portion, as will be described in further detail below.

Figure 3:
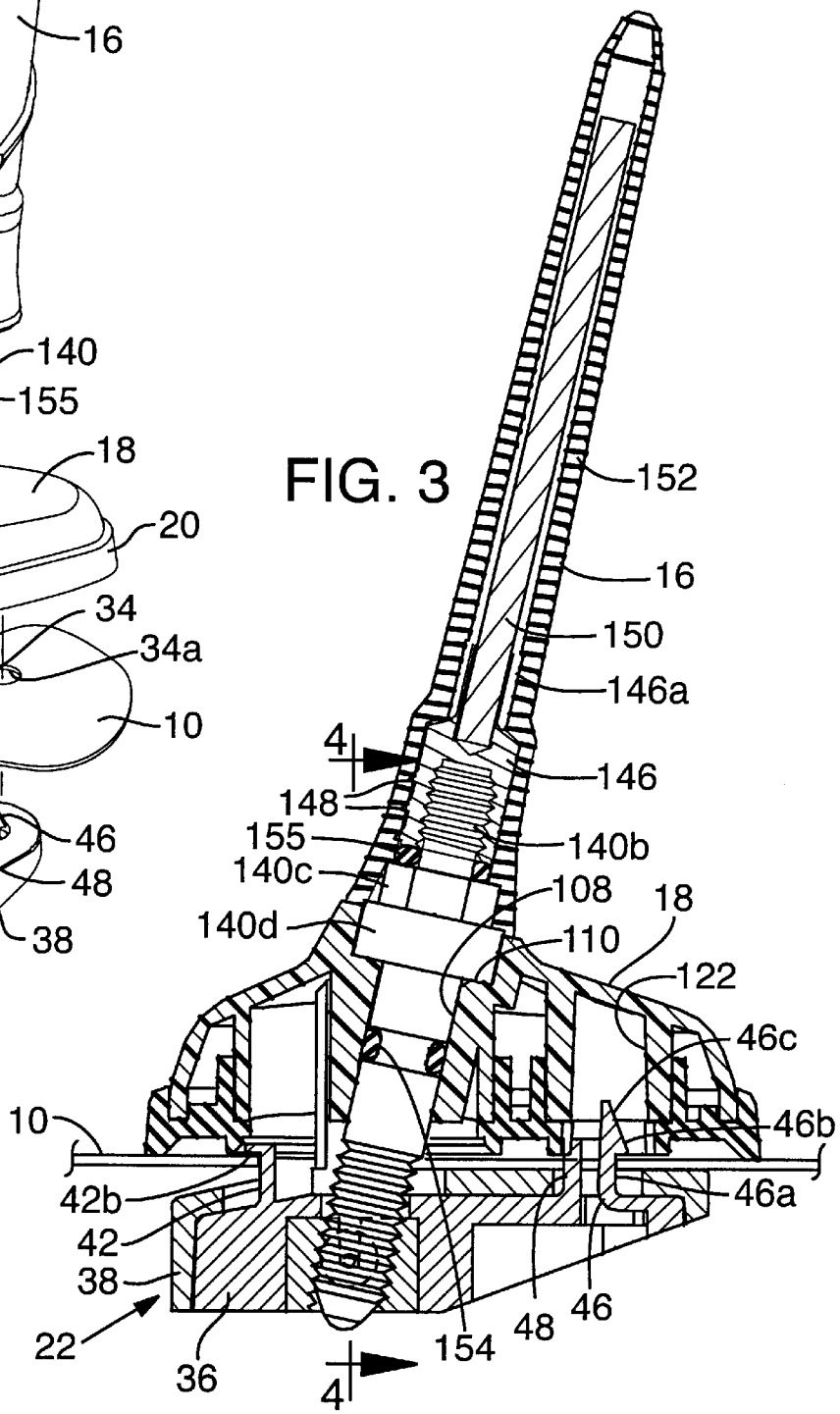
FIG. 3 is an enlarged cross-sectional view of the assembly taken generally along the line 3—3 in FIG. 1.
Figures 4, 5:
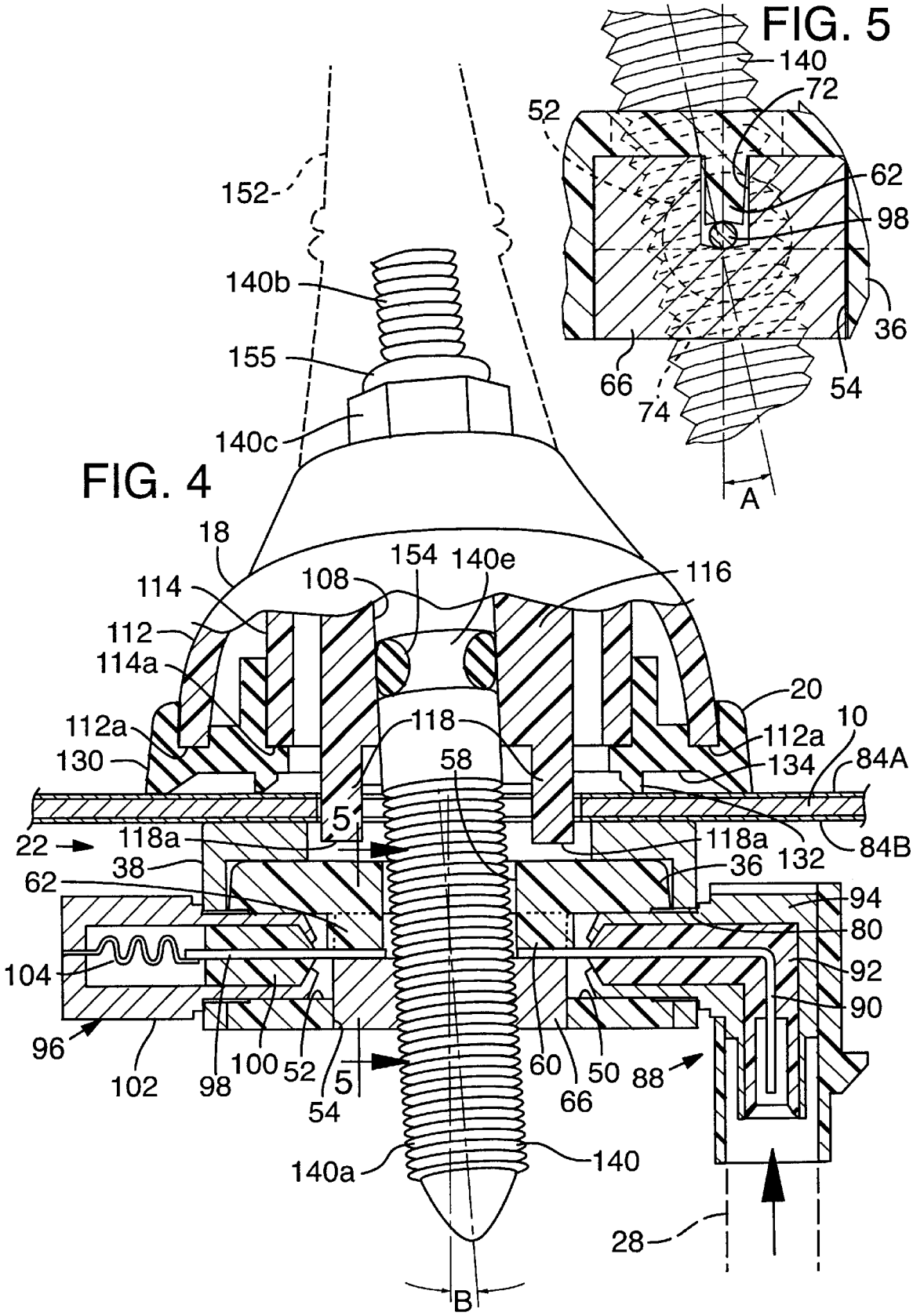
FIG. 4 is an enlarged cross-sectional view taken generally along the line 4—4 in FIG. 3.
FIG. 5 is an enlarged cross-sectional view taken generally along the line 5—5 illustrating a nut through which a connector screw extends.

The configuration of cover 38 is complementary to body 36, such that cover 38 fits over the top of body 36 as best illustrated in FIGS. 2–4.

Body 36 has a positioning portion 42 projecting upwardly from the major portion of body 36 adjacent one end of the body. Positioning portion 42 is arcuate, being formed as an arc portion of a circle which is less than a semi-circle. The positioning portion has an upstanding vertical element, or positioning projection, 42*a* and a lip 42*b*. Projection 42*a* is complementary in configuration to the convex curvature of the marginal edge portion 32*a* of opening 32 in roof 10. In an assembled condition, as illustrated in FIG. 3, positioning portion 42 extends upwardly through opening 32 in the roof panel with lip 42*b* engaging the top surface of the roof panel adjacent edge margin 32*a* to support mount 22 thereon. With positioning portion 42 being less than a semi-circle, it may be inserted upwardly through opening 32 and, by having a complementary arcuate configuration, positioning projection 42*a* engages the edge margin 32*a* of opening 32 and lip 42*b* rests on an edge margin of opening 32 throughout the full arc of portion 42. Positioning portion 42 also has laterally spaced upstanding rearwardly facing edge portions 42*c*.

Figure 6:
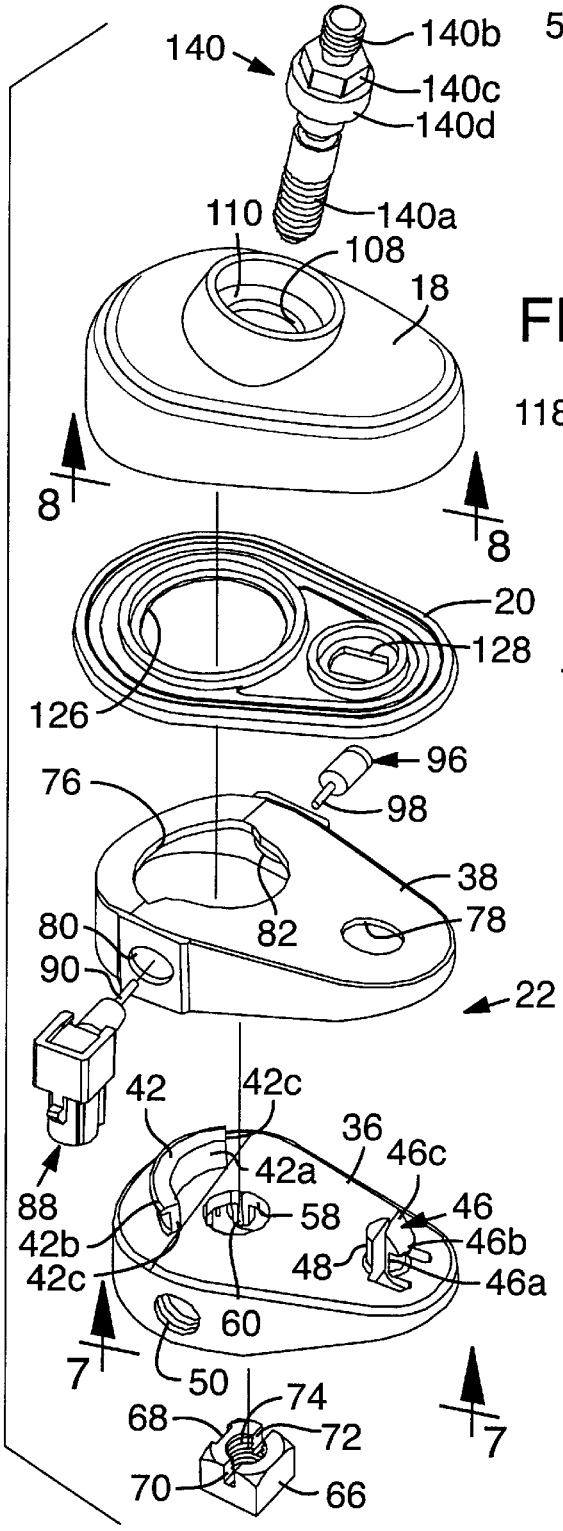
FIG. 6 is an exploded top-rear view of the component parts in the system.

Adjacent the opposite end of the top of body 36 is a catch member 46. This catch member has an upstanding resilient portion 46*a* and a horizontally outwardly projecting tang, or latch, portion 46*b*. An outwardly facing surface 46*c* is inclined away from the outer end of tang 46*b* on extending upwardly therefrom. The distance between the outwardly facing surfaces of upstanding portion 42*a* of positioning portion 42 and upstanding portion 46*a* of catch member 46 are substantially equal to the distance between remotely positioned marginal edges 32*a*, 34*a* of openings 32, 34, respectively. The normally at-rest position for catch member 46 relative to the main portion of body 36 is as illustrated in FIGS. 3 and 6.

Positioning portion 42 and catch member 46 permit convenient installation of internal mount 22 on vehicle panel 10. Explaining further, an installer only needs to position internal mount 22 adjacent one side of the vehicle panel 10 (here the underside), extend positioning portion 42 through hole 32, and engage lip 42*b* on the opposite side surface of the panel. After the lip 42*b* has been engaged with the marginal edge portion 32*a* of hole 32, the installer presses the opposite end of body 36 upwardly so that catch member 46 moves through hole 34. As this occurs, the inclined surface 46*c* of the catch member guides the catch member past edge margin 34*a*, causes the catch member to resiliently bend backwardly to move through opening 34, and, upon the tang portion 46*b* reaching the outer surface of vehicle panel 10 allows the catch member to snap back into the position illustrated in FIG. 3, to engage the outer surface of panel 10 and hold internal mount 22 thereon.

Referring again to FIGS. 2, 3 and 6, a substantially rigid upstanding backing post 48 is positioned a short distance behind resiliently mounted catch member 46. This post is spaced a distance from catch member 46 a distance slightly greater than the projecting dimension of tang 46*b*. Thus, the spacing between the post and catch member 46 is sufficient to allow the catch member to bend rearwardly toward post 48 to move through and eventually catch the edge margin of opening 34. However, should the catch inadvertently be pressed more forcefully in that direction, the post 48 will provide support therefor.

Figure 7:
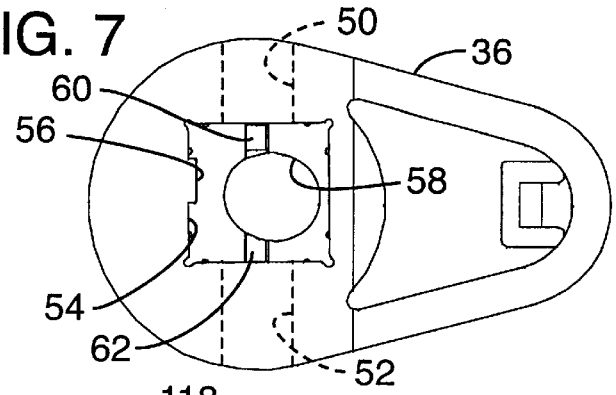
FIG. 7 is an enlarged bottom view of one of the components taken generally along the line 7—7 in FIG. 6.

Body 36 also has a first-bore 50 extending laterally therethrough from one side, and, as illustrated in dashed outline in FIG. 7, a second bore 52 extending through its opposite side aligned with bore 50. Referring still to FIG. 7, the underside of body 36 has a substantially square cavity 54 formed therein, with a protrusion 56. A bore 58 extends generally vertically through body 36 and opens into cavity 54. A pair of similarly formed downwardly projecting legs 60, 62 extend about halfway down the sides of cavity 54 at opposite sides of bore 58. One of these is illustrated in FIG. 5.

Figure 9:
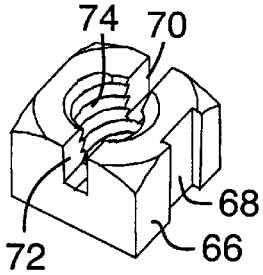
FIG. 9 is an enlarged view of a nut used in the system rotated 180° from its position shown in FIG. 6.

Referring to FIGS. 3, 6 and 9, a conductive metal nut 66 in the assembly has a substantially square configuration with an indentation 68 along one of its sides. The nut also has a pair of aligned notches 70, 72 on opposite sides of its threaded central bore 74. The nut may be inserted in cavity 54 with indentation 68 receiving protrusion 56 and notches 70, 72 receiving legs 60, 62, respectively. The threaded bore 74 is aligned with bore 58 in body 36. As best seen in FIGS. 3 and 5, threaded bore 74 in nut 66 is slanted rearwardly from the vertical at an angle A. Further, as best seen in FIG. 4, threaded bore 74 in nut 66 is inclined to one side by an angle B from the vertical, such that a compound angle is provided in the nut to produce the desired rearward sweep of the antenna and a sidewise inclination to place the antenna in a desired orientation when mounted on a vehicle panel which may have a degree of sidewise slope.

Referring again to FIGS. 2, 4 and 6, cover 38, also referred to herein as a conductive plate, has a pair of openings 76, 78 in its upper surface through which positioning portion 42, catch member 46 and post 48 may extend. Also, it has aligned bores 80 in its opposite sides which align with bores 50, 52 in body 36.

With the internal mount 22, including body 36 and cover 38, mounted on the underside of roof panel 10, as best seen in FIG. 4, cover 38 is interposed between body 36 and vehicle panel 10. Opposite surfaces of vehicle panel 10 are painted. Layers of paint 84A, 84B are illustrated on the external and interior surfaces of the panel, respectively. Cover 38, thus is separated from the sheet metal of panel 10 by the internal layer of paint 84B.

Referring to FIGS. 4 and 6, an electrical connector 88 is coupled to internal mount 22. The electrical connector is an L-shaped connector and, as best seen in FIG. 4, has a center wire 90, an insulating layer 92, and a conducting layer 94 surrounding insulating layer 92. Connector 88 is received through bores 80, 50 in the cover 38 and body 36, with wire 90 being received between the notch portion 70 of nut 66 and leg 60 of body 36. Extending into the bores from the opposite side of mount 22 is an electrical connector 96, which includes an elongate central wire 98, an insulating layer 100, and an outer conducting layer 102. An element 104 electrically connects center wire 98 with conducting layer 102. The element 104 may be either an inductor, a resistor, or a combination thereof, as will be described in greater detail below. Wire 98 would be captured between a notch portion 72 of nut 66 and a depending leg 62 of the body 36 as illustrated in FIG. 5. Wire 90 is similarly captured between notch 70 and leg 60 at the opposite side of nut 66. As is illustrated in FIG. 4, the conducting layers, or portions, of electrical connectors 88, 96 engage, and thus are conductively connected to cover 38.

Figure 8:
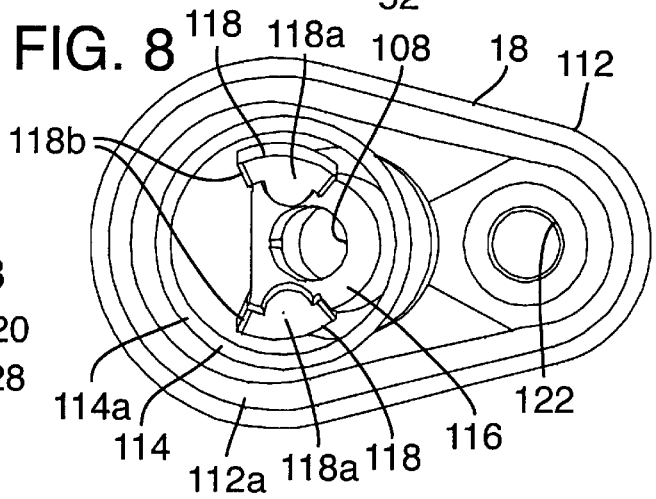
FIG. 8 is an enlarged bottom view of another of the components taken generally along the line 8—8 in FIG. 6.
Figure 10:
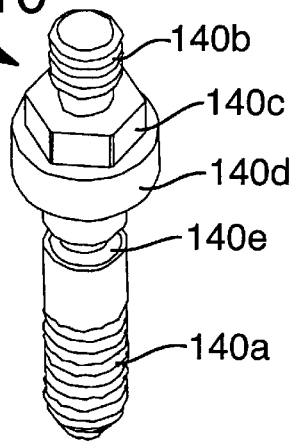
FIG. 10 is an enlarged perspective view of a screw connector in the assembly.

Referring to FIGS. 6–8, external mount 18 has a plan view outline configuration generally similar to that of body 36 of the internal mount. Referring to FIGS. 3 and 4, mount 18 has a substantially centrally disposed bore 108, which is oriented at substantially the same compound angle as previously described for the compound angle for the threaded bore of nut 66. A shoulder 110 is provided adjacent the top of bore 108.

Body 18 is formed of a non-conductive material, such as plastic, and has an outer skirt portion 112 with a lower, or under, surface 112*a*. An inner skirt 114, with an undersurface 114*a*, is positioned inwardly from skirt 112 and surrounds the central portion 116 of the mount through which bore 108 extends. At the lower end of central portion 116 are feet, or legs, 118, the undersurfaces 118*a* of which are disposed at a lower elevation than undersurfaces 112*a* and 114*a* of the outlying skirts. As is possibly best illustrated in FIG. 8, the forward marginal edge portions 118*b* of legs 118 are separated and are positioned to engage rearwardly facing upstanding margin portions 42*c* of positioning portion 42 (FIG. 6).

A cavity 122 in the rear portion of mount 18 receives catch member 46 when the components are assembled as illustrated in FIG. 3.

An elastomeric seal, or boot, 20, as best illustrated in FIG. 6, has various channels formed in its upper surface to receive depending skirt portions of body 18. Further, it has an opening 126 adjacent its forward end which is large enough to receive positioning portion 42, and depending feet 118, and a rear opening 128 which is large enough to receive catch member 46 and post 48. The underside of seal 20 has depending sealing ridges 130, 132, which extend downwardly from the major plane 134 of the underside of seal 20 fully about the underside of the seal body. As is best illustrated in FIG. 4, the undersurfaces 118*a* of feet 118 extend downwardly substantially below the major plane 134 of the seal, for a purpose to be described below.

An elongate connector screw 140 has a lower set of threads 140*a* and an upper set of threads 140*b*. A hex-shaped wrench-gripping portion 140*c* is adjacent threads 140*b*, and a cylindrical bearing portion, or collar, 140*d* underlies hex portion 140*c*. Between threads 140*a* and bearing 140*d* is a necked-down weakened section 140*e*. Section 140*e* is weakened by being in-cut such that, should a torsional force be exerted on the screw above a pre-selected force, the screw will break at this region, rather than damaging other components in the system.

Screw 140 is adapted to extend downwardly through bore 108, with its lower section 140*a* being screwed into nut 66. Bearing portion 140*d* rests on shoulder 110, and hex portion 140*c* is accessible for tightening.

Upper threaded portion 140*b* is adapted to receive an internally threaded radiator receiver 146. The lower end of receiver 146 is screwed onto threads 140*b*, and its upper region has a receiving sleeve 146*a* which receives the lower end of an elongate antenna radiator 150. Sleeve 146*a* is crimped about radiator 150. The outer portion of the lower section of receiver 146 has ridges 148 formed thereabout, such that, when a pliable radiator-enclosing sheath 152 is pressed thereon, the ridges will hold it on the receiver.

Referring to FIGS. 3 and 4, an O-ring seal 54 is received in the necked-down portion 140*e* of screw 140.

Describing installation and operation of the apparatus thus described, holes 32, 34, or a single oval hole with fore-to-aft dimension similar to the space between edge margin portions 32*a*, 34*a*, is formed in the vehicle panel 10. Conductive cover 38 is placed over body 36, as illustrated in FIGS. 2–4, and electrical connectors 88, 96 are inserted through sidebores 50, 52. The center wires 90, 98 of the electrical connectors rest against the undersides of legs 60, 62 in body 36. Nut 66 then is inserted into cavity 54. When nut 66 is inserted into cavity 54, center wires 90, 98 are captured between the bottoms of notches 70, 72 and legs 60, 62. The nut is frictionally held in cavity 54.

The installer then inserts internal mount 22 on the underside of vehicle panel 10. This is done by inserting positioning portion 42 upwardly through hole 32 such that lip 42*b* rests atop the front marginal edge portion 32*a* of the hole. The rear end of the internal mount is then pressed upwardly, with catch member 46 moving upwardly through opening 34 with its tang portion 46*b* catching atop edge margin 34*a* of hole 34. In this position, conductive cover 38 rests against the painted undersurface of the vehicle panel 10.

Seal 20 then is attached to the underside of external mount 18 and these are fit down over the top of openings 32, 34. As best seen in FIG. 4, the lower edge margins portions of inner and outer skirt portions, 112, 114, are frictionally held in receiving grooves and chambers of seal 20. Since the seal is composed of an elastomeric material and may have a high coefficient of friction, member 18 will be frictionally held in the seal once assembled so an installer need handle only one composite assembly when placing the outer mount during installation. This frictional interconnection may be sufficient so that should the composite assembly be dropped, numbers 18, 20 will not separate. Legs 118 extend downwardly through opening 34 (see FIG. 4) with the forward edges 118*b* of legs 118 adjacent the rearwardly facing edge portions 42*c* of positioning portion 42. Screw 140 is inserted through bore 108 of external mount 18 and is screwed into nut 66. As it is screwed into nut 66, the internal and external mounts are drawn toward each other on opposite sides of vehicle panel 10.

The initial position of the parts prior to screw tightening is illustrated in FIGS. 3 and 4. Members 42, 46 extend upwardly through holes 32, 34 in the vehicle panel 10 in such a manner as to hold body 36 in the illustrated position relative to panel 10. Legs 118 extend downwardly through hole 32 and engage member 42 while cavity 122 in member 18 and opening 128 in boot 20 receive member 46. Such inter-connections hold members 18, 20, 22 in selected positions relative to each other and to the vehicle panel when screw 140 is tightened. The assembly is held against rotation relative to the panel when the screw is tightened.

As screw 140 is tightened, ridges, or rims, 130, 132 of seal 20 are compressed against panel 10. These are compressed until such time as the undersides 118*a* of legs 118 engage the top of body 36 such that they may proceed no further. At this time, the elastomeric seal 20 has been compressed (e.g. 30 percent) to its desired position and torsional forces on screw 140 are stopped. As screw 140 is tightened the angle A at which it extends through the assembly tends to urge surfaces 42*c* and 118*b* tightly together. With the forward edges 118*b* of legs 118 engaging the rearward edges 42*c* of positioning portion 42 the inner and outer members are substantially secured against subsequent movement relative to each other.

Should torsional forces above the breaking force of weakened section 140*e* be exerted on the screw 140 it will break at section 140*e* to protect other portions of the system. This selected breaking force may be approximately five Newton meters. As the screw is tightened, center wires 90, 98 are forced into tight conducting engagement with nut 66.

When the screw 140 is installed, friction produced between o-ring 154 and bore 108 serve to hold the screen in position.

After screw 140 has been tightened as desired an o-ring 155 is installed on screw 140 above hex section 140*c*. Antenna housing 16, consisting of receiver 146, radiator 150 and sheath 152, then is screwed onto upper threads 140*b* of screw 140. Radiator 150 thus is coupled through screw 140 to nut 66 and, thus, to center wires 90, 98 of the electrical connectors 88, 96.

Cover 38, being separated by paint layer 84B from vehicle panel 10, has a capacitive connection to the vehicle, with the paint layer acting as a dielectric insulator between conductive cover 38 and conductive vehicle panel sheet 10.

Figure 11:
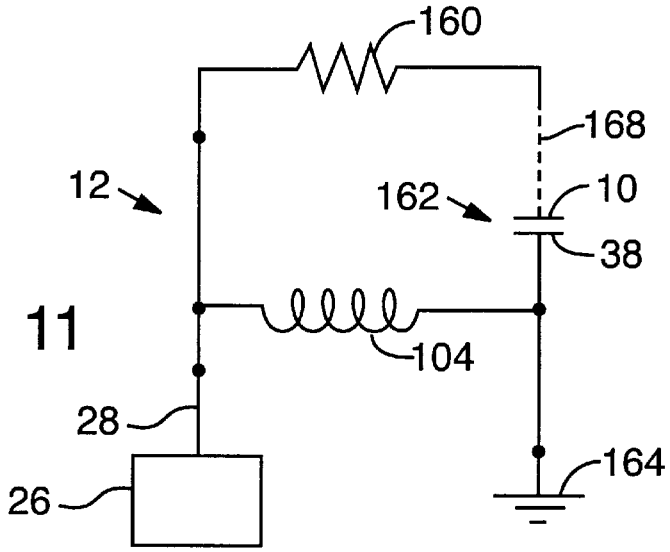
FIG. 11 is a simplified electrical schematic of a portion of a circuit of the disclosure.

FIG. 11 illustrates a brief circuit schematic for the antenna, capacitor and inductor or resistor. Telematic unit 26 is connected through cable 28 to the antenna assembly 12. The impedance of the antenna is indicated generally at 160.

A capacitor 162 provided by conductive cover plate 38 at one side, sheet metal vehicle panel 10 on the other side, and paint layer 84B previously described therebetween forming the dielectric insulation layer between these two. Element 104 illustrated previously in electrical connector 96 is shown here as an inductor, but it should be recognized that it also could be a resistor. Ground for the system is indicated generally at 164.

Although there is no physical interconnection between the antenna (indicated by impedance 160) and vehicle panel 10 forming one side of capacitor 162, there is an electrical coupling through RF energy indicated in dashed outline at 168.

Thus, the antenna 160 is coupled in series with the capacitor 162 and the antenna/capacitor series combination is coupled in parallel with electrical element 104, which may be an indicator or resistor. As a result of the element 104, the telematic unit 26 detects the element 104 during an initialization period. Such a detection indicates that there is an electrical connection between the coaxial cable 28 and the internal antenna mount 22. Without such an element, the apparent DC open circuit (indicated at 168) would make it appear to the telematic unit 28 that no antenna is connected. This test is used during installation at a factory to ensure that the coaxial cable is properly connected to the antenna mount assembly 12.

The circuit is established so that the resistance to ground will be less than 10 Kohms. Those skilled in the art will recognize that the capacitive coupling created between the vehicle panel 10 and the plate 38 can be eliminated. For example, the plate 38 can have teeth of some kind for penetrating the vehicle paint and creating a direct short between the plate 38 and panel 10.

While a preferred embodiment of the antenna system and method for installing the same have been described herein, it should be obvious to those skilled in the art that variations and modifications are possible without departing from the spirit of the invention, which is set out in the following claims.

We claim:

1. An antenna mounting system comprising a first mount adapted to be disposed adjacent one surface of a vehicle panel and having a positioning portion adapted to extend through an opening in the vehicle panel, a second mount adapted to be disposed adjacent a surface of the vehicle panel opposite said one surface, a connector adapted to couple said first and second mounts to each other, and a conductive plate associated with one of said mounts adapted to form a capacitive coupling with said vehicle panel when positioned adjacent one of said surfaces.

2. The system of claim 1, wherein the capacitive coupling comprises said conductive plate, the vehicle panel, and an insulator positioned between the plate and panel.

3. The system of claim 2, wherein said insulator comprises a layer of paint.

4. The system of claim 1, which further comprises an antenna assembly attached to said first mount and electrically coupled to the conductive plate.

5. The system of claim 4, wherein said antenna is connected to electrical ground through said capacitive coupling, and said capacitive coupling and antenna are connected in parallel with an inductor.

6. The system of claim 4, wherein said antenna is connected to electrical ground through said capacitive coupling, and said capacitive coupling and antenna are connected in parallel with a resister.

7. The system of claim 1, wherein the positioning portion of said first mount comprises a positioning projection adapted to position the first mount in a predetermined position with respect to the opening formed in the vehicle panel, and a catch member adapted to releasably attach the first mount to the vehicle panel.

8. The system of claim 7, wherein the opening formed in the vehicle panel has a first edge margin and a second edge margin spaced therefrom, a lip on said positioning portion is positioned to engage said first edge margin and said catch member is positioned to engage said second edge margin.

9. The system of claim 8, wherein said first edge margin has a concave configuration and said positioning projection has a complementary convex arcuate portion and said lip extends outwardly from said arcuate portion and is adapted to engage said opposite vehicle panel surface.

10. The system of claim 8, wherein said first edge margin is semi-circular and said positioning projection is formed as an arc of a circle which is less than a semi-circle.

11. The system of claim 8, wherein said first mount comprises a main body portion, said catch member projects outwardly from said main body portion and has a catch tang adapted to engage said opposite surface of the vehicle panel, said catch member being resiliently mounted on said main body portion and having an at-rest portion relative to the main body portion, whereby the catch member may be urged from its at-rest position to allow the tang to move past its associated edge margin of the opening during mounting and then snap back toward its at-rest position to engage said opposite surface of the vehicle panel surface.

12. The system of claim 11, which further comprise a backing post projecting outwardly from said main body portion adjacent the side of said catch member opposite said catch tang, said backing post being spaced from said catch member a distance slightly greater than the distance which said catch tang projects to limit the distance which the catch member may be moved from its at-rest position in the direction of said backing post.

13. The system of claim 1, wherein said first mount is composed of an electrically non-conductive material, said connector comprises a conductive nut on said first mount and a conductive screw extending from said second mount and screwed into said nut, and said nut is electrically connected to said conductive plate.

14. The system of claim 13, wherein said screw is adapted to have an antenna attached thereto and said nut has a threaded bore which is disposed at a compound angle relative to the body of the nut to provide desired positioning for an antenna which may be connected to said screw.

15. The system of claim 1, wherein said connector comprises an elongate screw which has a weakened section intermediate its ends adapted to break if torsional forces over a pre-selected level are applied to the screw.

16. The system of claim 1, which further comprises an elastomeric seal member adapted to be interposed between said second mount and a vehicle panel surface, said connector comprises a screw connector adapted to draw said second member toward said panel surface during installation, and said second mount comprises an engaging portion positioned to be spaced a selected distance from said first mount when said seal member is interposed between the second mount and the vehicle panel surface in an uncompressed state and to engage a portion of said first mount to inhibit movement of the second mount toward the panel surface beyond a pre-selected point to achieve selected seal member compression.

17. The system of claim 1, wherein said first mount and said second mount comprise inter-engaging elements operable to maintain selected relative position between said first and second mounts upon installation and relative to said vehicle panel.

18. An antenna mounting system comprising a first mount having means adapted for inserting through an opening in a vehicle panel with a major portion of the mount adjacent one surface of the panel, means for retaining the first mount in a predetermined position relative to said opening, a second mount, means for attaching the second mount to the first mount with a major portion of the second mount adjacent the surface of the panel opposite said one surface, and means for attaching an antenna to one of said mounts and means for electrically coupling such antenna to electrical ground through a capacitive coupling.

19. The system of claim 18, which further comprises a conductive member and means for positioning said conductive member adjacent one of the surfaces of the vehicle panel to produce a capacitive coupling between the conductive member and the vehicle panel.

20. The system of claim 18, wherein the means for retaining the first mount comprises a snap-catch fitting.

21. The antenna mounting system of claim 18, wherein the means for retaining the first mount comprises a positioning portion having a projecting lip adapted to engage an edge margin of the vehicle panel on the surface of the panel opposite said one surface.

22. The antenna mounting system of claim 21, wherein the positioning portion and the projecting lip have a convex configuration.

23. An antenna mounting system comprising a first mount adapted to be disposed adjacent one surface of a vehicle panel and having a positioning portion adapted to extend through an opening in the vehicle panel, the positioning portion comprising a positioning projection adapted to position the first mount in a predetermined position with respect to the opening formed in the vehicle panel, and a snap-catch fitting adapted to releasably attach the first mount to the vehicle panel, a second mount adapted to be disposed adjacent a surface of the vehicle panel opposite said one surface, and a connector adapted to couple said first and second mounts to each other.

24. The system of claim 23, wherein the opening formed in the vehicle panel has a first edge margin and a second edge margin spaced from said first edge margin, said positioning projection is positioned on said first mount to engage said first edge margin and said catch member is positioned to engage said second edge margin.

25. The system of claim 24, wherein said first edge margin has a concave configuration and said positioning projection has a complementary convex portion and a projecting lip extending from said arcuate portion and adapted to engage said opposite vehicle panel surface.

26. The system of claim 24, wherein said first edge margin is semi-circular and said positioning projection is formed in an arc of a circle which is less than a semi-circle.

27. The system of claim 26, which further comprise a backing post projecting outwardly from said main body portion adjacent the side of said catch member opposite said catch tang, said backing post being spaced from said catch member a distance slightly greater than the distance which said catch tang projects to limit the distance which the catch member may be moved from it at-rest position in the direction of said backing post.

28. The system of claim 24, wherein said first mount comprises a main body portion, said catch member projects outwardly from said main body portion and has a catch tang adapted to engage said opposite surface of the vehicle panel, said catch member being resiliently mounted on said main body portion and having an at-rest position relative to the main body portion whereby the catch member may be urged from its at rest position to allow the tang to move past its associated edge margin of the opening during mounting and then snap back toward its at-rest position to engage said opposite surface of the vehicle panel surface.

29. The system of claim 23, wherein said connector comprises an elongate screw which has a weakened section intermediate its ends adapted to break if torsional forces over a pre-selected level are applied to the screw.

30. The system of claim 23, which further comprises an elastomeric seal member adapted to be interposed between said second mount and a vehicle panel surface, said connector comprises a screw connector adapted to draw said second member toward said panel surface during installation, and said second mount comprises an engaging portion positioned to be spaced a selected distance from said first mount when said seal member is interposed between the second mount and the vehicle panel surface in an uncompressed state and to engage a portion of said first mount to inhibit movement of the second mount toward the panel surface beyond a pre-selected point to achieve selected seal member compression.

31. The system of claim 23, wherein said first mount and said second mount comprise inter-engaging elements operable to maintain selected relative position between said first and second mounts upon installation.

32. The system of claim 23, which further comprises a conductive plate associated with one of said mounts adapted to form a capacitive coupling with said vehicle panel when positioned adjacent one of said surfaces.

33. The system of claim 32, wherein the capacitive coupling comprises said conductive plate, the vehicle panel, and a dielectric insulator positioned between the plate and panel.

34. The system of claim 33, wherein said insulator comprises a layer of paint.

35. The system of claim 32, which further comprises an antenna assembly attached to said first mount and electrically coupled to the conductive plate.

36. The system of claim 35, wherein said antenna is connected to electrical ground through said capacitive coupling, and said capacitive coupling and antenna are connected in parallel with an inductor.

37. The system of claim 36, wherein the impedance from the antenna to electrical ground is less than 10 Kohms.

38. The system of claim 35, wherein said antenna assembly is connected to electrical ground through said capacitive coupling, and said capacitive coupling and antenna are connected in parallel with a resistor.

39. The system of claim 38, wherein the resistance of the resistor is less than 10 Kohms.

40. The system of claim 32, wherein said first mount is composed of an electrically non-conductive material, said connector comprises a conductive nut on said first mount and a conductive screw extending from said second mount and screwed into said nut, and said nut is electrically connected to said conductive plate.

41. The system of claim 40, wherein said screw is adapted to have an antenna attached thereto and said nut has a threaded bore which is disposed at a compound angle relative to the body of the nut to provide desired positioning for an antenna which may be connected to said screw.

42. A method for attaching an antenna mount to a vehicle panel comprising the steps of placing a first mount adjacent one surface of the vehicle panel, inserting a positioning portion of the first mount through an opening formed in the panel, retaining the first mount in a predetermined position relative to the panel, and placing a second mount adjacent a surface of the vehicle panel opposite said one surface and coupling the second mount to the first mount.

43. The method of claim 42, which further comprises providing a conductive plate associated with one of said mounts and placing said conductive plate adjacent the vehicle panel with an insulator therebetween to produce a capacitive coupling with said vehicle panel.

44. The method of claim 43, which further comprises providing an inductor and connecting said capacitive coupling and inductor to electrical ground in parallel.

45. The method of claim 43, which further comprises providing a resistor and connection said capacitive coupling and resistor to electrical ground in parallel.

46. The method of claim 42, which further comprises providing a snap-lock connector on said first mount and upon inserting portions of said first mount through said opening actuating said snap-lock to retain the first mount in said predetermined position relative to said panel.

47. The method of-claim 42, which further comprises providing a screw connector and wherein the coupling of said first and second mounts includes a step of drawings said first and second mounts toward each other on opposite surfaces of the vehicle panel.

48. The method of claim 47, wherein said screw connector is disposed at an angle relative to the vehicle panel and on being tightened urges the first and second mount in opposite directions along paths extending substantially parallel to the vehicle panel to draw engaging portions of the first and second mounts into engagement with each other.

49. An antenna mounting system comprising a first mount adapted to be disposed adjacent one surface of a vehicle panel and having a positioning portion adapted to extend through an opening in the vehicle panel, the positioning portion comprising a positioning projection adapted to position the first mount in a predetermined position with respect to the opening formed in the vehicle panel, and an attaching catch member adapted to releasably attach the first mount to the vehicle panel, a second mount adapted to be disposed adjacent a surface of the vehicle panel opposite said one surface, and a connector adapted to couple said first and second mounts to each other, wherein the opening formed in the vehicle panel has a first edge margin and a second edge margin spaced from said first edge margin, said positioning projection is positioned on said first mount to engage said first edge margin and said catch member is positioned to engage said second edge margin.

50. The system of claim 49, wherein said first edge margin has a concave configuration and said positioning projection has a complementary convex portion and a projecting lip extending from said arcuate portion and adapted to engage said opposite vehicle panel surface.

51. The system of claim 49, wherein said first edge margin is semi-circular and said positioning projection is formed in an arc of a circle which is less than a semi-circle.

52. The system of claim 51, which further comprise a backing post projecting outwardly from said main body portion adjacent the side of said catch member opposite said catch tang, said backing post being spaced from said catch member a distance slightly greater than the distance which said catch tang projects to limit the distance which the catch member may be moved from it at-rest position in the direction of said backing post.

53. The system of claim 49, wherein said first mount comprises a main body portion, said catch member projects outwardly from said main body portion and has a catch tang adapted to engage said opposite surface of the vehicle panel, said catch member being resiliently mounted on said main body portion and having an at-rest position relative to the main body portion whereby the catch member may be urged from its at rest position to allow the tang to move past its associated edge margin of the opening during mounting and then snap back toward its at-rest position to engage said opposite surface of the vehicle panel surface.

54. An antenna mounting system comprising a first mount adapted to be disposed adjacent one surface of a vehicle panel and having a positioning portion adapted to extend through an opening in the vehicle panel, the positioning portion comprising a positioning projection adapted to position the first mount in a predetermined position with respect to the opening formed in the vehicle panel, and an attaching catch member adapted to releasably attach the first mount to the vehicle panel, a second mount adapted to be disposed adjacent a surface of the vehicle panel opposite said one surface, and a connector adapted to couple said first and second mounts to each other, wherein said connector comprises an elongate screw which has a weakened section intermediate its ends adapted to break if torsional forces over a pre-selected level are applied to the screw.

55. An antenna mounting system comprising a first mount adapted to be disposed adjacent one surface of a vehicle panel and having a positioning portion adapted to extend through an opening in the vehicle panel, the positioning portion comprising a positioning projection adapted to position the first mount in a predetermined position with respect to the opening formed in the vehicle panel, and an attaching catch member adapted to releasably attach the first mount to the vehicle panel, a second mount adapted to be disposed adjacent a surface of the vehicle panel opposite said one surface, a connector adapted to couple said first and second mounts to each other, and an elastomeric seal member adapted to be interposed between said second mount and a vehicle panel surface, said connector comprises a screw connector adapted to draw said second member toward said panel surface during installation, and said second mount comprises an engaging portion positioned to be spaced a selected distance from said first mount when said seal member is interposed between the second mount and the vehicle panel surface in an uncompressed state and to engage a portion of said first mount to inhibit movement of the second mount toward the panel surface beyond a pre-selected point to achieve selected seal member compression.

56. An antenna mounting system comprising a first mount adapted to be disposed adjacent one surface of a vehicle panel and having a positioning portion adapted to extend through an opening in the vehicle panel, the positioning portion comprising a positioning projection adapted to position the first mount in a predetermined position with respect to the opening formed in the vehicle panel, and an attaching catch member adapted to releasably attach the first mount to the vehicle panel, a second mount adapted to be disposed adjacent a surface of the vehicle panel opposite said one surface, a connector adapted to couple said first and second mounts to each other, a conductive plate associated with one of said mounts adapted to form a capacitive coupling with said vehicle panel when positioned adjacent one of said surfaces, and an antenna assembly attached to said first mount and electrically coupled to the conductive plate, wherein said antenna is connected to electrical ground through said capacitive coupling, and said capacitive coupling and antenna are connected in parallel with an inductor.

57. The system of claim 56, wherein the impedance from the antenna to electrical ground is less than 10 Kohms.

58. An antenna mounting system comprising a first mount adapted to be disposed adjacent one surface of a vehicle panel and having a positioning portion adapted to extend through an opening in the vehicle panel, the positioning portion comprising a positioning projection adapted to position the first mount in a predetermined position with respect to the opening formed in the vehicle panel, and an attaching catch member adapted to releasably attach the first mount to the vehicle panel, a second mount adapted to be disposed adjacent a surface of the vehicle panel opposite said one surface, a connector adapted to couple said first and second mounts to each other, a conductive plate associated with one of said mounts adapted to form a capacitive coupling with said vehicle panel when positioned adjacent one of said surfaces, and an antenna assembly attached to said first mount and electrically coupled to the conductive plate, wherein said antenna assembly is connected to electrical ground through said capacitive coupling, and said capacitive coupling and antenna are connected in parallel with a resistor.

59. The system of claim 58, wherein the resistance of the resistor is less than 10 Kohms.

60. An antenna mounting system comprising a first mount adapted to be disposed adjacent one surface of a vehicle panel and having a positioning portion adapted to extend through an opening in the vehicle panel, the positioning portion comprising a positioning projection adapted to position the first mount in a predetermined position with respect to the opening formed in the vehicle panel, and an attaching catch member adapted to releasably attach the first mount to the vehicle panel, a second mount adapted to be disposed adjacent a surface of the vehicle panel opposite said one surface, a connector adapted to couple said first and second mounts to each other, and a conductive plate associated with one of said mounts adapted to form a capacitive coupling with said vehicle panel when positioned adjacent one of said surfaces, wherein said first mount is composed of an electrically non-conductive material, said connector comprises a conductive nut on said first mount and a conductive screw extending from said second mount and screwed into said nut, and said nut is electrically connected to said conductive plate.

61. The system of claim 60 wherein said screw is adapted to have an antenna attached thereto and said nut has a threaded bore which is disposed at a compound angle relative to the body of the nut to provide desired positioning for an antenna which may be connected to said screw.

62. An antenna mounting system comprising a first mount adapted to be disposed adjacent one surface of a vehicle panel and having a positioning portion adapted to extend through an opening in the vehicle panel, a second mount adapted to be disposed adjacent a surface of the vehicle panel opposite said one surface, a connector adapted to couple said first and second mounts to each other, an antenna assembly attached to said first mount, said antenna assembly being connected to electrical ground, and an inductor or resistor connected in parallel with said antenna to said electrical ground.

* * * * *

UNITED STATES PATENT AND TRADEMARK OFFICE

CERTIFICATE OF CORRECTION

PATENT NO. : 6,509,878 B1
DATED : January 21, 2003
INVENTOR(S) : Tornatta et al.

It is certified that error appears in the above-identified patent and that said Letters Patent is hereby corrected as shown below:

Column 1,
Line 21, “than10” should read -- than 10 --.
Line 41, “as aspect” should read -- an aspect --.

Column 2,
Line 29, “system,12” should read -- system, 12 --.
Line 47, “is should” should read -- it should --.

Column 3,
Line 17, “on extending” should read -- or extending --.

Column 6,
Line 51, “o-ring 154” should read -- O-ring 154 --.
Lines 53-54, “o-ring 155” should read -- O-ring 155 --.

Column 10,
Line 2, “it at-rest” should read -- its at-rest --.
Line 11, “its at rest” should read -- its at-rest --.

Column 11,
Line 24, “connection” should read -- connecting --.
Line 31, “of-claim 42” should read -- of claim 42 --.
Line 34, “drawings said” should read -- drawing said --.

UNITED STATES PATENT AND TRADEMARK OFFICE

CERTIFICATE OF CORRECTION

PATENT NO. : 6,509,878 B1
DATED : January 21, 2003
INVENTOR(S) : Tornatta et al.

It is certified that error appears in the above-identified patent and that said Letters Patent is hereby corrected as shown below:

Column 12,
Line 10, "it at-rest" should read -- its at-rest --.
Line 18, "its at rest" should read -- its at-rest --.

Signed and Sealed this

Second Day of May, 2006

JON W. DUDAS
*Director of the United States Patent and Trademark Office*